United States Patent [19]

Bagepalli

[11] Patent Number: 4,895,501

[45] Date of Patent: Jan. 23, 1990

[54] ROTARY COMPRESSOR WITH VANE POSITIONED TO REDUCE NOISE

[75] Inventor: Bharat S. Bagepalli, Schenectady, N.Y.

[73] Assignee: General Electric Company, Schenectady, N.Y.

[21] Appl. No.: 288,669

[22] Filed: Dec. 22, 1988

[51] Int. Cl.[4] ..... F01C 1/02; F04C 2/04

[52] U.S. Cl. ..... 418/63; 418/248

[58] Field of Search ..... 418/63, 248, 249

[56] References Cited

U.S. PATENT DOCUMENTS 1,409,054 3/1922 Marion ..... 418/63

FOREIGN PATENT DOCUMENTS 877052 5/1953 Fed. Rep. of Germany ..... 418/63

OTHER PUBLICATIONS

Sano et al., 1984, International Compressor Engineering Conference, "Analysis of Hermetic Rolling Piston Type Compressor Noise, and Countermeasures", pp. 242–250, 1984.

*Primary Examiner*—Leonard E. Smith
*Assistant Examiner*—John A. Savio, III
*Attorney, Agent, or Firm*—William Squire; James C. Davis, Jr.; Paul R. Webb, II

[57] ABSTRACT

The noise of a rotary compressor is reduced by orienting the sliding vane. In particular, the vane is oriented such that the force component which is perpendicular to the vane motion and which tends to jam the vane and create high frictional effects is minimized. The vane is tilted towards the high pressure chamber so as to result in a smaller force component perpendicular to the direction of vane motion, which direction corresponds to the direction of the vane slot itself. The vane may be shifted laterally from its previously known position in order to achieve the same lower friction and lower noise effects.

14 Claims, 2 Drawing Sheets

FIG. 2
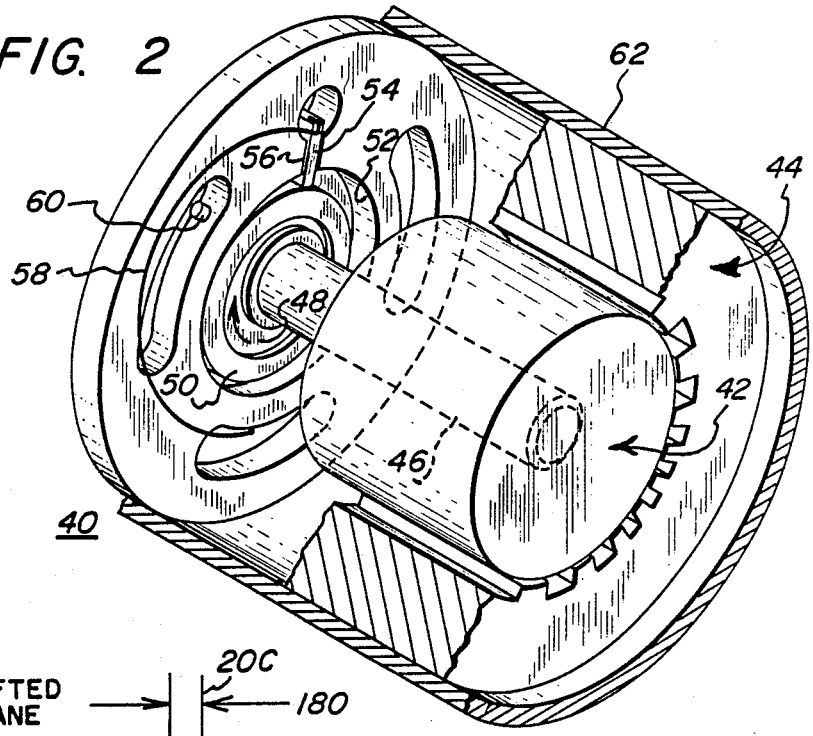
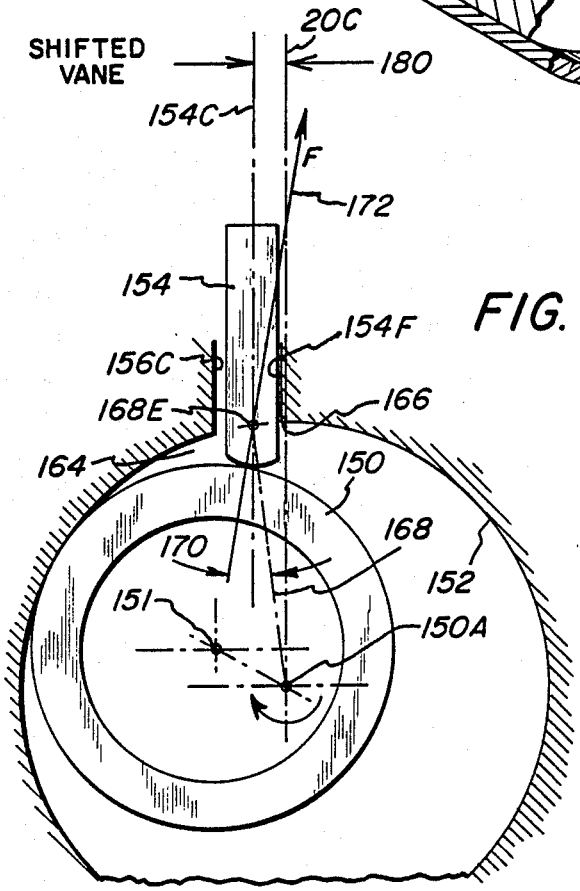
FIG. 4

ROTARY COMPRESSOR WITH VANE POSITIONED TO REDUCE NOISE

BACKGROUND OF THE INVENTION

The present invention relates to rotary compressors. More specifically, the present invention relates to a rotary compressor having a sliding vane positioned in order to reduce noise.

A rotary type of compressor as commonly used for refrigerators and air conditioners often generates high frequency (4 KHz to 10 KHz) noise. Indeed, some refrigerators use rotary compressors which show a strong almost pure-tone noise of about 4 KHz, this being a frequency to which the human ear is most sensitive.

Various methods of reducing rotary compressor noise have previously been considered.

One approach is to redesign the casing of the rotary compressor so as to reduce the sound radiation from it. The noise heard by the human ear results from the vibration of the casing which encloses the whole compressor structure. Modifying the sound radiation pattern is necessary for this approach. The radiation pattern can be modified by changing the bending rigidity of the compressor, i.e., changing the casing thickness or adding stiffness to the casing. However, redesigning the casing is relatively expensive and is therefore undesirable.

Another way of attenuating the compressor noise is by controlling the compressor gas spectrum directly. Any resonator type of device built into the discharge port works as a mechanical filter. This may adversely affect the compressor efficiency depending on the structure of the resonator.

Other attempts to reduce the high frequency noise have included changes in orifice design, clearances, and root radii. These changes have only been partially successful and are somewhat disadvantageous in that they often reduce the efficiency of the compressor.

One of the potential sources for the noise in a rotary compressor is the frictional effect between the vane and the cylinder surfaces which may best be explained by reference to prior art FIG. 1. FIG. 1 shows a simplified view of portions of a rotary compressor 10 including a cylindrical wall 12 and a roller or rolling piston 14 which eccentrically rotates about rotation axis 16. The rotation axis 16 is also a center axis of symmetry of the cylindrical wall 12. The roller 14 has a center axis of symmetry 18 which is offset from the rotation axis 16 to provide for the eccentric rotation. A sliding vane 20 is disposed in a slot 22 in the cylindrical wall 12. The slot 22 includes a close side 24C which is relatively close to a compression chamber 26 and a far side 24F which is relatively far from the compression chamber 26. Most of the noise generated by such a compressor occurs when the roller 14 is in the high pressure portion of its cycle. That is, most of the noise occurs when refrigerant is being compressed in compression chamber 26. A possible cause of the noise or contributing factor to the noise is jamming of the sliding vane 20 against the walls or sides of the slot 22. In particular, the roller 14 applies a force 28 to the vane 20. This force 28 includes a component parallel to the vane center line 20C (which vane center line is radial to the rotation axis 16) and a component perpendicular to the vane center line 20C. (The vane center line 20C of course corresponds to the center of the slot 22 and is the direction of movement of the vane 20.) The component of force 28 normal to the vane center line 20C tends to jam the vane 20 against the side 24F at point 30 and cause high frictional resistance, thus impeding the smooth motion of the vane and generating noise.

Although the above approaches at noise reduction have been somewhat useful, there remains a need for significantly reducing the noise from a rotary compressor without reducing the efficiency of the compressor.

OBJECTS AND SUMMARY OF THE INVENTION

Accordingly, it is a primary object of the present invention to provide a new and improved compressor design.

A more specific object of the present invention is to provide a compressor design having a noise reduction arrangement which is relatively easy and inexpensive to implement.

A further object of the present invention is to provide a noise reduction technique for a rotary compressor Yet another object of the present invention is to provide a noise reduction arrangement for a rotary compressor which has little or no effect on the compressor efficiently.

The above and other objects of the present invention which will become more apparent as the description proceeds are realized by a rotary compressor having a cylindrical wall and a compression chamber within the cylindrical wall. A roller is mounted for eccentric rotation about a rotation axis within the cylindrical wall. A vane is slideable mounted in a slot in the cylindrical wall. The vane moves along a vane center line.

The vane is advantageously positioned to minimize noise by being disposed at an angle relative to a most direct radius extending from the rotation axis to the vane. As used herein, the most direct radius shall refer to a radius which intersects the center of the tip of the vane when the vane is flush with the cylindrical wall.

The positioning of the vane may alternately require that the vane center line be disposed at an angle relative to the most direct radius extending from a center axis to the vane, the center axis being the axis of symmetry of the cylindrical wall.

The present invention may alternately be described as constructed such that the vane center line is offset from the rotation axis by a separation distance.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 2 shows a perspective view with parts broken away of a rotary compressor according to the present invention;

FIG. 4 shows a simplified front view illustrating the vane positioning for another embodiment of the present invention.

DETAILED DESCRIPTION

Figure 1:
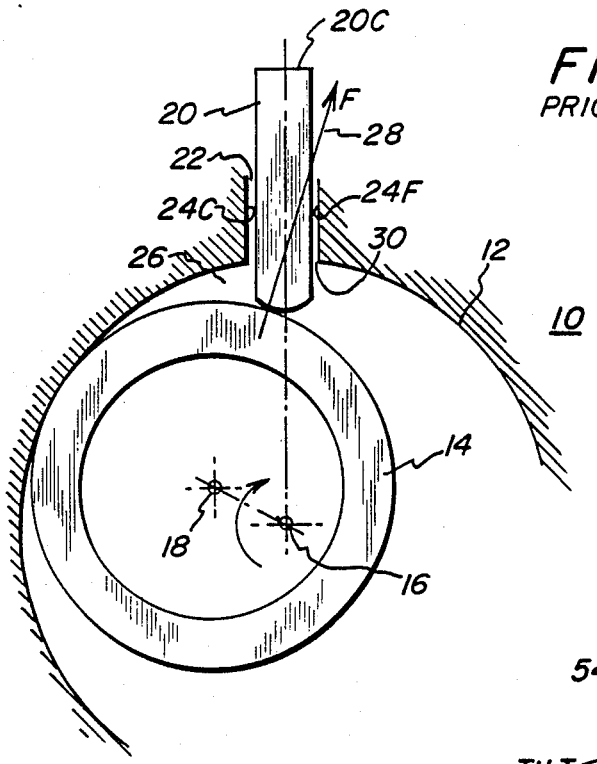
FIG. 1 PRIOR ART
FIG. 1 illustrates a prior art rotary compressor as discussed above.

As shown in FIG. 2, the rotary compressor 40 of the present invention includes a motor having rotor 42 and stator 44 which operate in known fashion to rotate a shaft 6. An eccentric 48 is mounted to the shaft and a roller 50 surrounds the eccentric and rotates eccentrically relative to a cylindrical wall 52. A vane 54 is disposed in a slot 56 in the wall 52. A spring 58 is used to bias the slideable vane inwardly. An accelerometer 60 may be used in known fashion for the rotary compressor 40 for experimental measurements. A casing 62 surrounds the structure.

The general operation of the components of FIG. 2 is well known and the discussion which follows will emphasize unique features with respect to the vane 54 and the slot 56.

Figure 3:
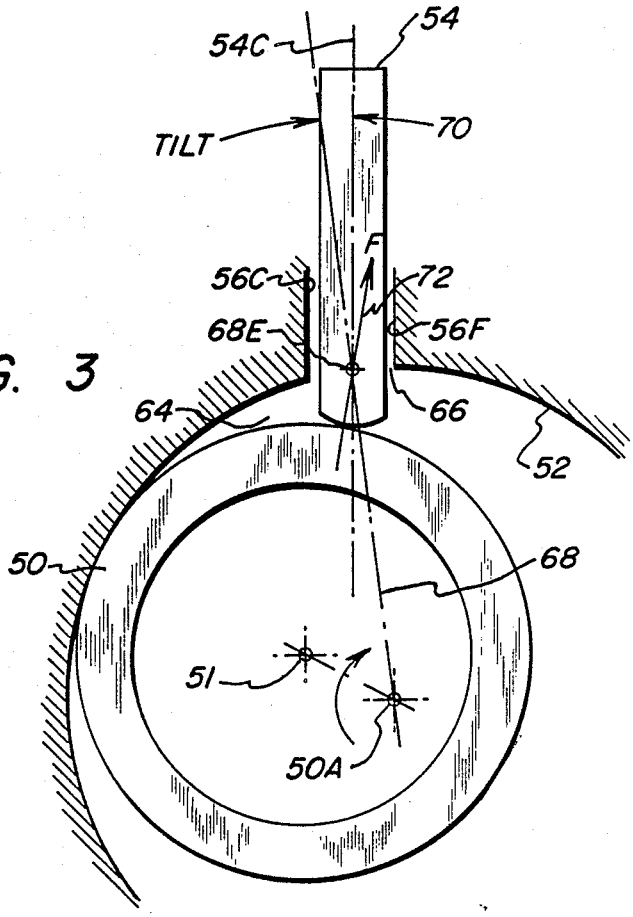
FIG. 3 shows a simplified front view illustrating the vane positioning for one embodiment of the present invention.

With reference now to FIG. 3, a simplified and enlarged view of the roller 50, cylindrical wall 52, sliding vane 54, and slot 56 is shown. A compression chamber 64 is disposed between the roller 50 and the cylindrical wall 52. The roller 50 rotates eccentrically about a rotation axis 50A, which axis also corresponds to the axis of symmetry or center line of the cylindrical wall 52. The center line or axis or symmetry of the roller 50 itself is labeled 51 and, as shown, is offset from axis 50A in order to provide the eccentricity.

The vane 54 and slot 56 are oriented so as to reduce the jamming friction which might otherwise occur at location 66 in similar fashion to the jamming friction at location 30 of prior art FIG. 1. In particular, the center line 54C of sliding vane 54, which center line also corresponds to the direction of movement when sliding vane 54 slides in slot 56, is angularly offset with respect to a most direct radius 68. The most direct radius 68 extends from the rotation axis 50A to the central bottom tip of the vane 54 when the vane 54 is flush with the cylindrical wall 52. In other words, the most direct radius 68 terminates at point 68E, which point might also be expressed as the midsection of the slot 56 along an extension of the arc of the cylindrical wall 52. By providing the tilt shown as angle 70, the force 72 has a reduced component which is normal to the sides 56C and 56F of the slot 56 (which sides are parallel to center line 54C). Accordingly, the force 72 has a reduced amount of force which would drive the vane 54 towards the far side 56F (far from the compression chamber 64, whereas close side 56C is relatively close to the compression chamber 64). This reduced component of force normal to the far side 56F of slot 56 results in reduced friction at and around point 66 of the slot 56. Accordingly, less noise will be produced. The slot 56 may easily be made in similar fashion to the slot 22 of the prior art FIG. 1. However, the slot 56 is not radial to the center of the cylindrical wall 52, which center corresponds to rotation axis 50A. By providing the tilt angle 70 such that the slot 56 and vane 54 have their lower ends tilted towards the high pressure side (compression chamber 64), the noise and friction will be reduced by a relatively simple and inexpensive to implement procedure.

The tilt angle for a particular rotary compressor should be greater than or equal to ½° and less than or equal to 10° . More preferably, the tilt angle is greater than or equal to 1° . The actual optimum tilt angle for different rotary compressors will depend upon various parameters of the compressors including difference between the inner radius of the cylinder and the outer radius of the roller), the outer radius of the roller, and the vane nose radius (the radius of curvature of the tip of the vane, which tip contacts the roller). For a particular embodiment rotary compressor considered by the inventor, the tilt angle should more specifically be 3° plus or minus 1° .

Among additional other factors which may help to determine an optimal value for the tilt angle in the coefficient of friction between the vane and the roller. Assuming a reasonably low coefficient of friction, the present inventor has determined that the maximum tilt angle 70 should advantageously be specified by:

$$\text{max. tilt angle} = \arctan E/(R+V)$$

where

E is the eccentricity of the compressor,

R is the outer radius of the roller, and

V is the vane nose radius.

The stated formula is the maximum value for the tilt angle, whereas the minimum value for the tilt angle for such a rotary compressor would be one-tenth of the maximum value. More specifically, the tilt angle would be within 10% of one-half of the specified maximum value. This one-half of the maximum could be considered as an optimum value.

It should be again briefly noted that the tilt angle would be the angle relative to the most direct radius extending from the rotation axis to the vane. However, since the center axis of symmetry of the cylindrical wall is colinear with the rotation axis, the tilt angle may also be specified as the angle between the vane center line and the most direct radius extending from the center axis to the vane. As used herein, a "tilt angle" will necessarily mean an angle greater than angles resulting from manufacturing tolerance.

With reference now to FIG. 4, an alternate embodiment is shown wherein the components are numbered in the "100" series and with the same last two digits as the corresponding number, if any, in the embodiment of FIG. 3. In particular, roller 150 is disposed within the cylindrical wall 152 of a rotary compressor also having a sliding vane 154. The slideable vane 154 slides in a slot 156 having a close side 156C and a far side 156F. In the embodiment of FIG. 4, the vane 154 has been shifted leftwardly from the prior art arrangement of FIG. 1, this being illustrated by reference to line 20C corresponding to the previous position for the center line of the vane as illustrated in prior art FIG. 1. The shift in the vane axis is shown as 180 in FIG. 4. The force 172 exerted by the roller 150 on the slideable vane 154 will have a reduced component normal to the slot 156 such that there will be reduced friction at portion 166.

Although FIG. 4 has been shown conceptually as the shifting of a slideable vane from the prior art position of FIG. 1, it should also be noted that the effect of such a hift results in a tilt 170 between the vane center line 154C and most direct radius 168. As with the embodiment of FIG. 3, the vane center line (which also corresponds to the direction of movement or sliding of the vane) and the sides of the slot 156 (which are parallel to the vane center line 154C) are disposed so as to be at an angle 170 relative to a radial line 168 from the rotation axis 150A, which axis is also the axis of symmetry of cylindrical wall 152.

With reference to the range of the shift of the vane center line 154C for the embodiment of FIG. 4, a particular rotary compressor should advantageously have a shift which is greater than or equal to 0.01 inch and less than or equal to 0.1 inch. More generally, the offset or separation distance corresponding to 180 of FIG. 4 should preferably be less than or equal to the eccentricity and greater than or equal to one-tenth of the eccentricity. Of course, the "separation distance" as used herein will necessarily mean an offset greater than manufacturing tolerance.

The maximum amounts of shift and maximum specified values for the tilt angle are believed necessary to avoid other adverse effects. Increasing the tilt angle beyond the stated range of 10° may have adverse effects such as the vane seizing the roller.

Although the above discussion with respect to the ranges has treated the tilt angle arrangement of FIG. 3 separately from the offset arrangement of FIG. 4, it should be noted that the tilt angle design of FIG. 3 also provides a separation distance or offset (between vane center line and rotation axis) and, in similar fashion, the offset arrangement of FIG. 4 provides for a tilt angle. Accordingly, the offset design of FIG. 4 may be considered as having a tilt angle with the specified ranges and, likewise, the tilt angle arrangement of FIG. 3 may be considered as having the separation or offset distances specified for the offset design. As discussed previously, the tilt design has modified the previous rotary compressor design by tilting the vane, whereas the offset design has modified the previous or prior art design by shifting the vane.

Although various specific constructions have been shown and described herein, it is to be understood that these are for illustrative purposes only. Various modifications and adaptations will be apparent to those of skill in the art. Accordingly, the scope of the present invention should be determined by reference to the claims appended hereto.

What is claimed is:

1. A rotary compressor comprising:

a cylindrical wall;

a compression chamber within said cylindrical a roller mounted for eccentric rotation about a rotation axis with said cylindrical wall; and a vane slideably mounted in a slot in said cylindrical wall, said vane moving along a vane center line; said vane center line being disposed at a tilt angle relative to a most direct radius extending from the rotation axis to said vane such that the vane center line is tilted toward said compression chamber, said tilt angle being less than or equal to the arctan $E/(R+V)$ where E is the eccentricity of the compressor, R is the outer radius of the roller, and V is the vane nose radius.

2. The rotary compressor of claim 1 wherein said tilt angle is greater than or equal to $\frac{1}{2}$ and less than or equal to 10°.

3. The rotary compressor of claim 2 wherein said tilt angle is greater than or equal to 1°.

4. The rotary compressor of claim 1 wherein said tilt angle is plus 3° or minus 1°.

5. The rotary compressor of claim 1 wherein said tilt angle is greater than or equal to one-tenth of arctan $E/(R+V)$.

6. The rotary compressor of claim 5 wherein said tilt angle is within 10% of one-half arctan $E/(R+V)$.

7. The rotary compressor of claim 4 wherein the rotary compressor is a single vane rotary compressor.

8. The rotary compressor of claim 1 wherein the rotary compressor is a single vane rotary compressor.

9. A rotary compressor comprising:

a cylindrical wall;

a compression chamber within said cylindrical wall;

a roller mounted for eccentric rotation about a rotation axis within said cylindrical wall; and a vane slideably mounted in a slot in said cylindrical wall, said vane moving along a vane center line; said cylindrical wall being symmetric about a center axis and wherein said vane center line is disposed at a tilt angle relative to a most direct radius extending from said center axis to said vane such that the vane center line is tilted toward said compression chamber, said tilt angle being less than or equal to the arctan $E/(R=V)$ where is the eccentricity of the compressor, R is the outer radius of the roller, and V is the vane nose radius.

10. The rotary compressor of claim 9 wherein said tilt angle is greater than or equal to $\frac{1}{2}$° and less than or equal to 10°.

11. The rotary compressor of claim 9 wherein said tilt angle is plus 3° or minus 1°.

12. The rotary compressor of claim 9 wherein said tilt angle is greater than or equal to one-tenth of arctan $e/(R+V)$.

13. The rotary compressor of claim 12 wherein said tilt angle is within 10% of one-half arctan $E/(R+V)$.

14. The rotary compressor of claim 9 wherein the rotary compressor is single vane rotary compressor.

* * * * *